US011490755B2

(12) United States Patent
Shin

(10) Patent No.: US 11,490,755 B2
(45) Date of Patent: Nov. 8, 2022

(54) CROSS FOR CONTAINING SACRED UTENSIL OR WISHING NOTE

(71) Applicant: TOTAL SYSTEM CO., LTD, Namyangju-si (KR)

(72) Inventor: Kyung Ho Shin, Guri-si (KR)

(73) Assignee: TOTAL SYSTEM CO., LTD, Namyangju-si (KR)

( * ) Notice: Subject to any disclaimer, the term of this patent is extended or adjusted under 35 U.S.C. 154(b) by 159 days.

(21) Appl. No.: 17/053,766

(22) PCT Filed: Mar. 14, 2019

(86) PCT No.: PCT/KR2019/002928
§ 371 (c)(1),
(2) Date: Nov. 7, 2020

(87) PCT Pub. No.: WO2019/216537
PCT Pub. Date: Nov. 14, 2019

(65) Prior Publication Data

US 2021/0085116 A1 Mar. 25, 2021

(30) Foreign Application Priority Data

May 9, 2018 (KR) ..... 10-2018-0052846

(51) Int. Cl.
*A47G 33/02* (2006.01)

(52) U.S. Cl.
CPC ..... *A47G 33/02* (2013.01)

(58) Field of Classification Search
CPC ..... A47G 33/02
(Continued)

(56) References Cited

U.S. PATENT DOCUMENTS 3,392,821 A * 7/1968 Tracey ..... A47G 33/02 428/3

FOREIGN PATENT DOCUMENTS

JP 3006996 U 1/1995
JP 11-197366 A 7/1999
(Continued)

OTHER PUBLICATIONS

Eom, KR 200459957 Y1 machine translation, Apr. 25, 2012, entire translation (Year: 2012).*
(Continued)

*Primary Examiner* — Humera N. Sheikh
*Assistant Examiner* — Katherine A Christy
(74) *Attorney, Agent, or Firm* — Maschoff Brennan

(57) ABSTRACT

A cross contains a sacred utensil or a wishing note and includes a transverse frame parallel with the ground, a first longitudinal frame perpendicular to the center part of the transverse frame, a first containing portion formed at the inner center of the first longitudinal frame from the lower surface of the first longitudinal frame toward the transverse and a first coupling member containing portion formed from the lower surface of the first longitudinal frame toward the outside of the first containing portion. A first frame magnet is contained in the first coupling member containing portion. A second longitudinal frame makes surface contact with the lower surface of the first longitudinal frame to be coupled thereto. A contained object support rack at the center part of the upper surface of the second longitudinal frame is positioned to correspond to the first containing portion of the first longitudinal frame.

5 Claims, 10 Drawing Sheets

(58) Field of Classification Search
USPC ..... 428/3
See application file for complete search history.

(56) References Cited

FOREIGN PATENT DOCUMENTS

| | | | |
|---|---|---|---|
| JP | 3172017 | U | 12/2011 |
| KR | 20-0228058 | | 6/2001 |
| KR | 20-0308364 | | 3/2003 |
| KR | 200360051 | Y1 | 8/2004 |
| KR | 10-2007-0114246 | | 11/2007 |
| KR | 20-2011-0000281 | | 1/2011 |
| KR | 20-0459957 | | 4/2012 |
| KR | 20-2012-0008436 | | 12/2012 |
| KR | 10-1305470 | | 9/2013 |
| KR | 101779177 | B1 | 9/2017 |

OTHER PUBLICATIONS

Su, JP 3172017 U machine translation, Dec. 1, 2011, entire translation (Year: 2011).*
KR Office Action dated Dec. 20, 2018 as received in Application No. 10-2018-0052846.
International Search Report dated Jun. 20, 2019 as received in Application No. PCT/KR2019/002928.

* cited by examiner

CROSS FOR CONTAINING SACRED UTENSIL OR WISHING NOTE

TECHNICAL FIELD

The present disclosure relates to a cross for containing a sacred object or a wish note, and more specifically, a cross for containing a sacred object or a wish note, including a transverse frame 100, a rear space 101, a rear magnet 101*a*, a first longitudinal frame 200, a first containing portion 201, a first coupling member containing portion 202, a first frame magnet 203, a second longitudinal frame 300, a contained object support 301, a contained object insertion space 301*a*, a contained object cover member 302, an opening 302*a*, a second coupling member containing portion 303, and a second frame magnet 304.

BACKGROUND ART

In general, in churches and cathedrals, cross sculptures are installed. In cathedrals, three-dimensionally sculpted Jesus statues are mounted on the cross.

Individual believers wear or carry crosses in the form of accessories such as necklaces, or display the same on tables at home.

As well known in the art, the cross is a religious mark that symbolizes Christianity, and is placed in churches, cathedrals, or Christian homes and is used as an object for worship.

In other words, the cross, which is placed in churches, Christian homes, and the like such that it can be recognized more easily, requires higher religious aesthetics for expression of religious messages, holiness, and faith.

As a conventional technology related to the cross, Korean Utility Model Application Publication No. 20-2011-0000281 discloses a wall mounting type holy rood. The conventional technology document discloses a wall mounting type holy rood including a cross body having a storage groove formed on one surface to store sacred objects, and a cross cover detachably coupled to the cross body with the storage groove, wherein the cross body includes a first insertion groove formed to put the cross cover in a standing position, and a second insertion groove allowing a candle to be put therein.

As another conventional technology, Korean Utility Model No. 20-0459957 discloses a cross sculpture. This document discloses a cross sculpture including 12 lower vertical tubes vertically mounted on a bottom base, 12 upper vertical tubes to be mounted vertically at the top of the lower vertical tubes, 12 horizontal tubes horizontally arranged between the upper and lower vertical tubes, and a connecting member arranged to connect the horizontal tubes to the vertical tubes, wherein the connecting member includes a pair of horizontal connecting plates with through-holes allowing each of the horizontal tubes to pass therethrough, and a pair of vertical connecting plates to be coupled with ends of each of the upper and lower vertical tubes.

As another conventional technology, Korean Utility Model No. 20-0228058 discloses a holy rood with a lighting effect. This document discloses a holy rood with a lighting effect, including a through hole formed on the front and rear sides of the rood, a diffusion lens fitted into the through hole, an optical fiber connected to the diffusion lens, a lamp configured to supply light to the optical fiber, a color transmitting part configured to supply various colors to the optical fiber, and a multi-refractive diffusion plate configured to disperse light emitted through the diffusion lens, wherein the diffusion lens, the optical fiber, the color transmitting part, and the multi-refractive diffusion plate are arranged on a side of a standing signboard.

As another conventional technology, Korean Patent Application Publication No. 10-2007-0114246 discloses a holy rood structure. The prior art document discloses that the holy rood structure is configured by placing, in a seating portion in a cross frame, a lighting plate in which LED lamps are arranged in an electrical combination according to a certain shape of picture or character arrangement, and that the lighting is implemented in a cross shape by the LED lamps that emit light of various colors to provide a mysterious mood, and it is easy to repair the rood structure in case of failure by replacing only the broken lighting plate.

The above-mentioned conventional technologies relate to a general cross. In Catholicism, particularly, in a cathedral, a Jesus statue is three-dimensionally carved on a cross, and believers can directly gaze at the Jesus statue from the front. However, when believers look at the cross from a different position, the believers may have to face the side or the back of the Jesus statue.

In addition, the above-described conventional technologies fail to provide a solution to an issue raised when individual believers possess or wear a holy rood. In particular, they fail to solve the need for believers to retain sacred objects with a faith related note to express faith.

PRIOR ART LITERATURE

Patent Documents (Patent Document 1) KR 20-0308364 (Mar. 11, 2003)

(Patent Document 2) KR 10-2007-0114246 (Nov. 30, 2007)

(Patent Document 3) KR 10-1305470 (Sep. 2, 2013)

(Patent Document 4) KR 20-2012-0008436 (Dec. 10, 2012)

DISCLOSURE

Technical Problem

Therefore, the present disclosure has been made in view of the above problems or needs, and it is one object of the present disclosure to provide a cross for containing a sacred object or a wish note to believers to deepen faith.

It is another object of the present disclosure to provide a space for containing sacred objects or wish notes such that believers can conveniently keep the contents together with the cross.

It is another object of the present disclosure to provide a longitudinal frame detachably coupled to the cross such that the believers can use the cross conveniently.

It is another object of the present disclosure to provide a contained object support allowing a sacred object or a wish note to be inserted into a hollow portion formed therein such that the inserted object is securely fixed.

It is another object of the present disclosure to provide a contained object cover member to cover the contained object and the contained object support such that the inserted object is safely fixed and stored.

It is another object of the present disclosure to provide a magnetic member on the back of the cross such that the cross is firmly attached to the bible or the like so as to be easily stored and carried while deepening faith.

The objects to be achieved in the present disclosure are not limited to those mentioned above. Additional objects and features of the disclosure will be set forth in part in the description which follows and in part will become apparent to those having ordinary skill in the art upon examination of the following.

Technical Solution

A cross for containing a sacred object or a wish note related to an example of the present invention for achieving the above-described objects may include a transverse frame 100 arranged parallel to the ground to constitute the cross.

The cross may also include a first longitudinal frame 200 perpendicularly arranged across a center of the transverse frame 100.

Here, the cross may include a first containing portion 201 formed in an inner center of the first longitudinal frame 200 to extend from a bottom surface of the first longitudinal frame 200 toward the transverse frame 100.

The cross may also include a first coupling member containing portion 202 formed outside the first containing portion 201 in the bottom surface of the first longitudinal frame 200.

In this case, the cross may include a first frame magnet 203 arranged to be contained in the first coupling member containing portion 202.

The cross may also include a second longitudinal frame 300 coupled to the bottom surface of the first longitudinal frame 200 in surface contact therewith.

The cross may also include a contained object support 301 provided to a central portion of a top surface of the second longitudinal frame 300 and disposed at a position corresponding to the first containing portion 201 of the first longitudinal frame 200.

The cross may also include a contained object cover member 302 arranged to be contained in the first containing portion 201 and to cover the contained object support 301.

Here, the cross may include a second coupling member containing portion 303 formed outside the contained object support 301 at a position corresponding to the first coupling member containing portion 202; and a second frame magnet inserted into the second coupling member containing portion 303 to couple the first vertical frame 200 and the second vertical frame 300 by magnetic force with the first frame magnet 203.

The first frame magnet 203 may be formed to be shorter than the first coupling member containing portion 202, such that the first frame magnet 203 is hidden inside the first coupling member containing portion 202.

Here, the second frame magnet 304 may be formed to be longer than the second coupling member containing portion 303, such that the second frame magnet 304 protrudes from the second coupling member containing portion 303 to the outside. The protruding portion may be accommodated in the first coupling member containing portion 202.

The contained object cover member 302 may be formed in a cylindrical shape to be open on one side facing the second coupling member containing portion 303 and be closed on an opposite side to cover the contained object support 301.

Here, the contained object cover member 302 may be provided with an opening 302*a* formed in a portion of the side surface from one side facing the second coupling member containing portion 303 to the opposite side.

The contained object support 301 may further include a contained object insertion space 301*a* having a length extending from a top surface of the second longitudinal frame 300 to a top surface of the first containing portion 201, the contained object insertion space allowing the contained object to be fitted thereinto.

The first longitudinal frame 200 or the transverse frame 100 may further include a rear space 101 formed in a rear surface thereof to allow a rear magnet 101*a* to be inserted into the rear space 101.

Advantageous Effects

As the present disclosure provides a cross for containing a sacred object or a wish note, the following effects may be obtained.

First, by providing the cross for containing a sacred object or a wish note to believers, the faith of the believers may be raised.

Second, a containing space to contain the sacred objects or wish notes may be provided to allow believers to conveniently store and keep the contents with sacred notes along with the cross.

Third, as a longitudinal frame is detachably coupled to the cross, believers may be allowed to conveniently use the cross.

Fourth, as a contained object support allowing a sacred object or a wish note to be inserted into a hollow portion formed therein is provided, the inserted object may be securely fixed.

Fifth, as a contained object cover member is configured to cover the contained object and the contained object support, the inserted object may be safely fixed and stored.

Sixth, as a magnetic member is provided on the back of the cross such that the cross is firmly attached to the bible or the like, the contained object may be easily stored and carried while deepening faith.

The effects obtainable in the present disclosure are not limited to the above-mentioned effects, and other effects not mentioned herein will be clearly understood by those skilled in the art from the following description.

DESCRIPTION OF DRAWINGS

The accompanying drawings, which are included to provide a further understanding of the disclosure and are incorporated in and constitute a part of this application, illustrate preferred embodiment(s) of the invention and together with the detailed description of the present disclosure to explain the principle of the invention. Therefore, the present disclosure should not be interpreted as being limited to the accompanying drawings.

BEST MODE

Figure 1:
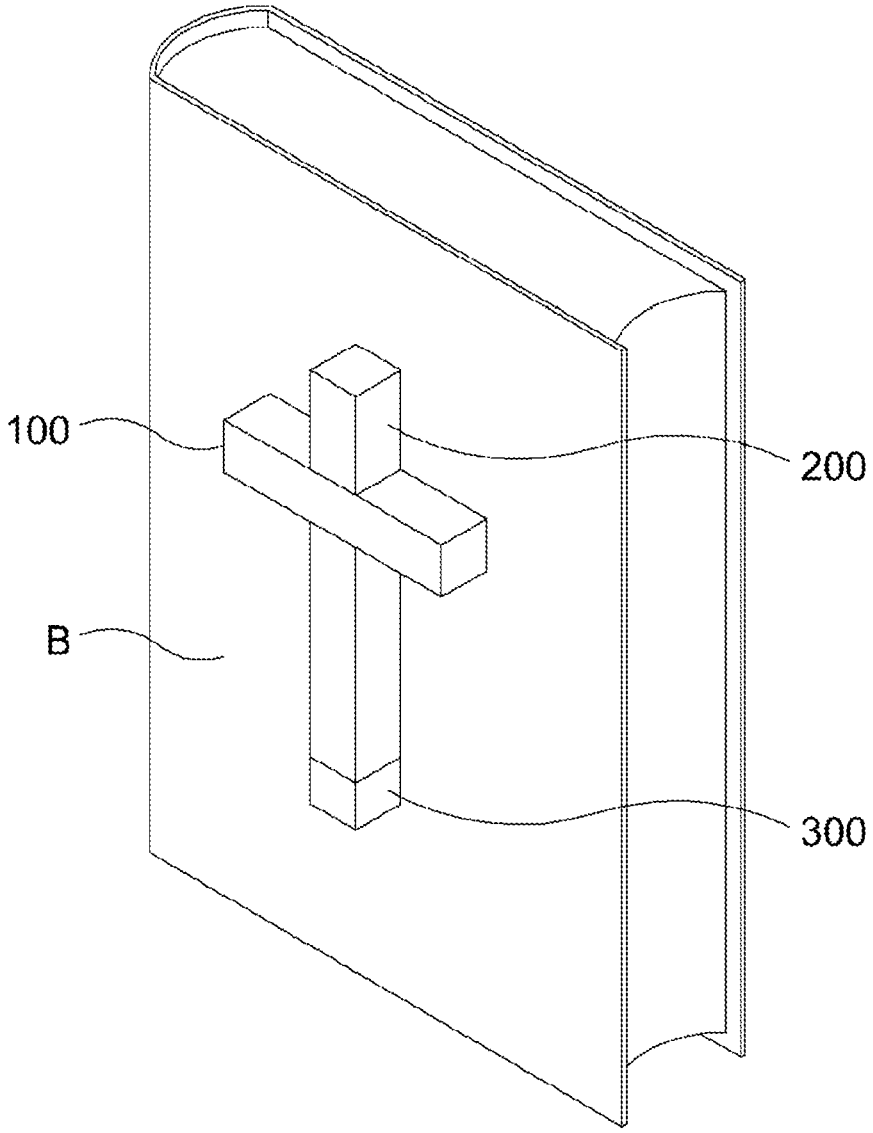
FIG. 1 is a perspective view of a cross for containing a sacred object or a wish note according to a preferred embodiment of the present disclosure, which is attached to the bible.

Descriptions of specific structures or functions of the embodiments according to the concept of the present invention disclosed in the present specification are provided only for the purpose of describing the embodiments according to the concept of the present invention. The concept of the present invention may be implemented in various forms and is not limited to the embodiments described herein.

Various changes can be made to the embodiments according to the concept of the present invention, and embodiments will be illustrated in the drawings and described in detail in the present specification. However, this is not intended to limit the embodiments according to the concept of the present invention to specific forms, and includes all changes, equivalents, or substitutes within the spirit and scope of the present invention.

Figure 2:
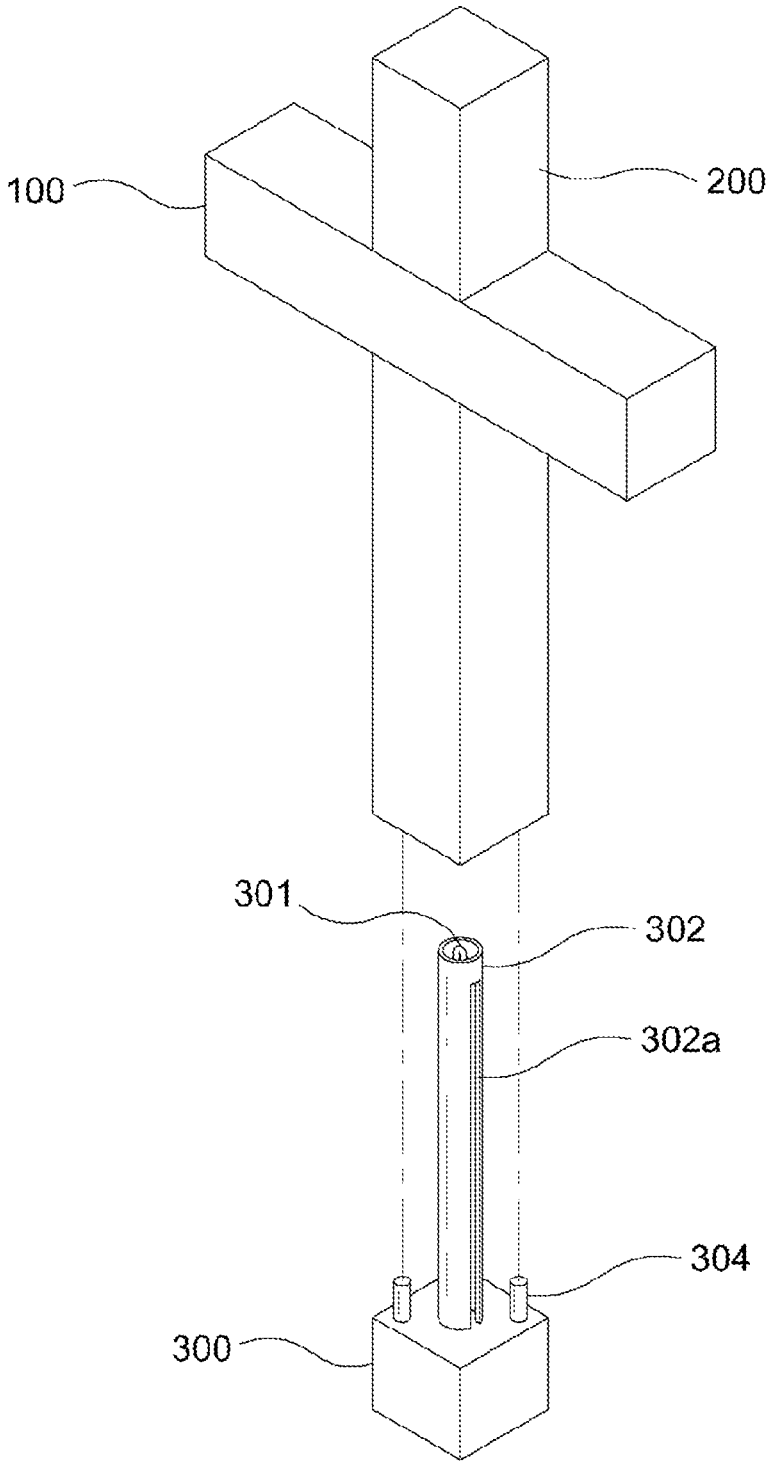
FIG. 2 is an exploded perspective view of the cross for containing a sacred object or a wish note according to the preferred embodiment of the present disclosure.
Figure 3:
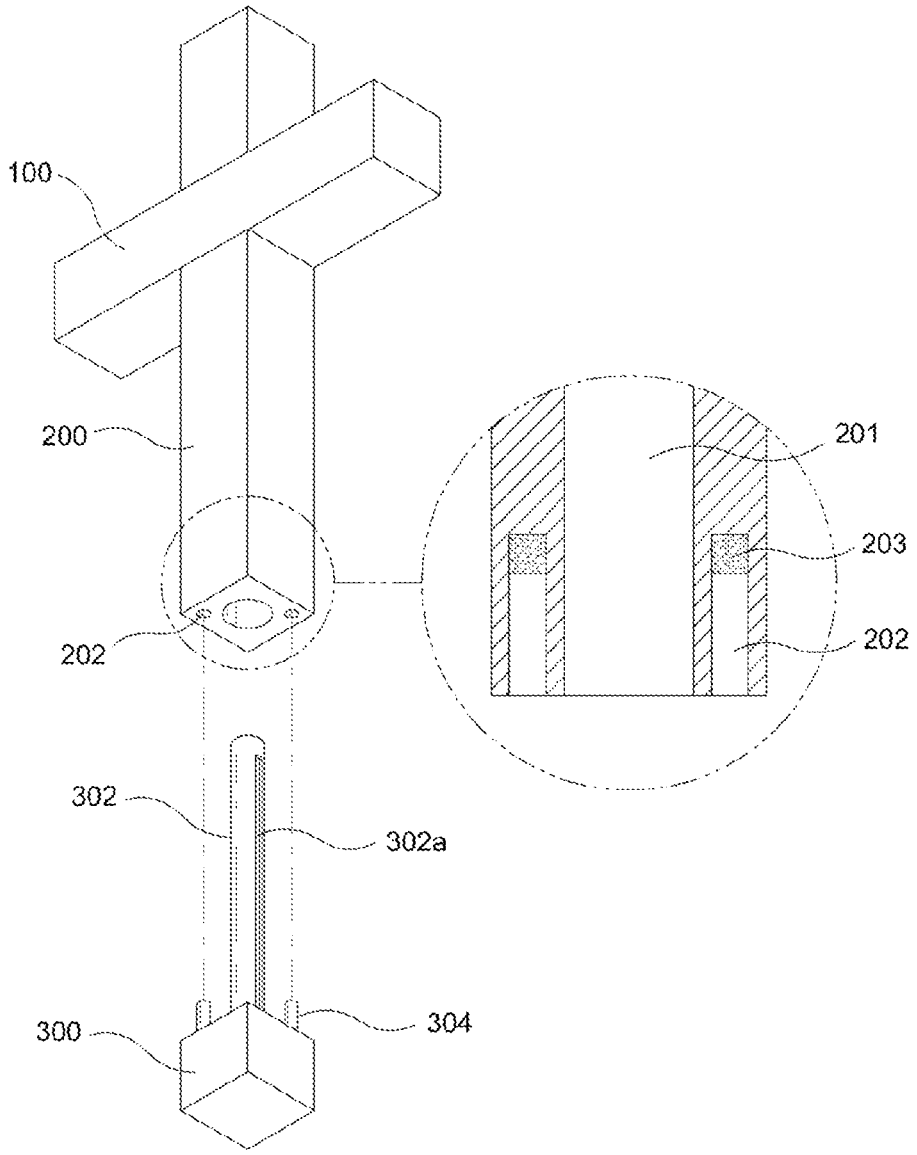
FIG. 3 is a perspective view and conceptual diagram showing in detail a first containing portion and a first coupling member containing portion of the cross for containing a sacred object or a wish note according to the preferred embodiment of the present disclosure.
Figure 4:
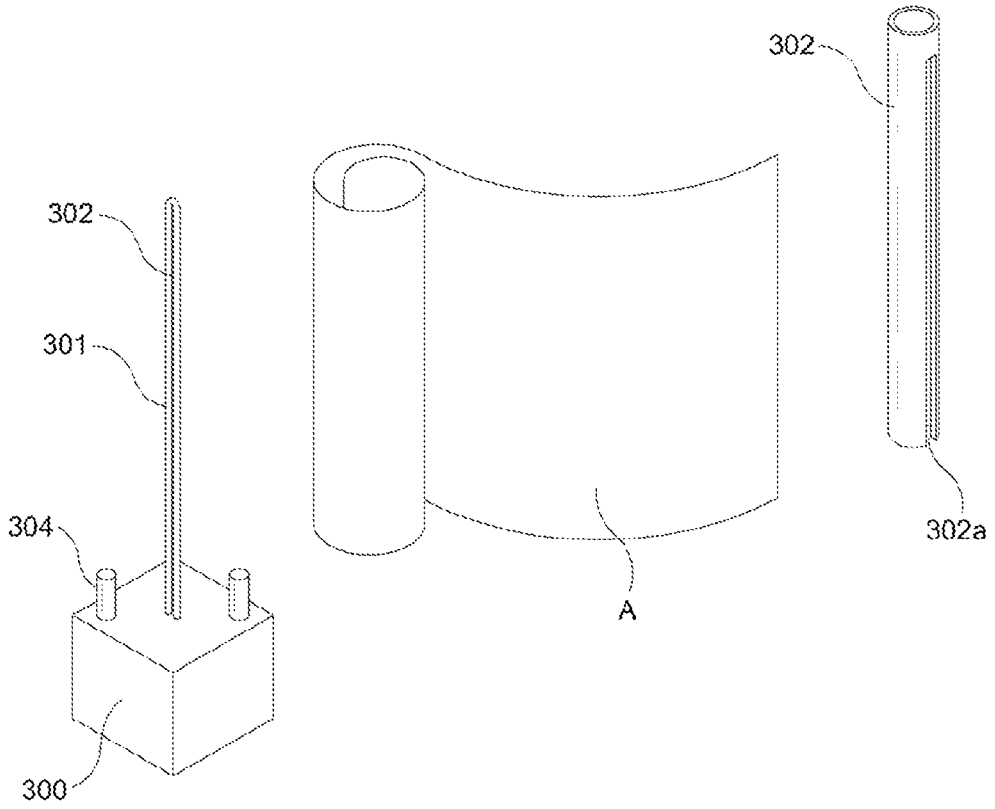
FIG. 4 is a perspective view illustrating in detail a contained object support, a contained object cover member, and a contained object insertion space of the cross for containing a sacred object or a wish note according to the preferred embodiment of the present disclosure.
Figure 5:
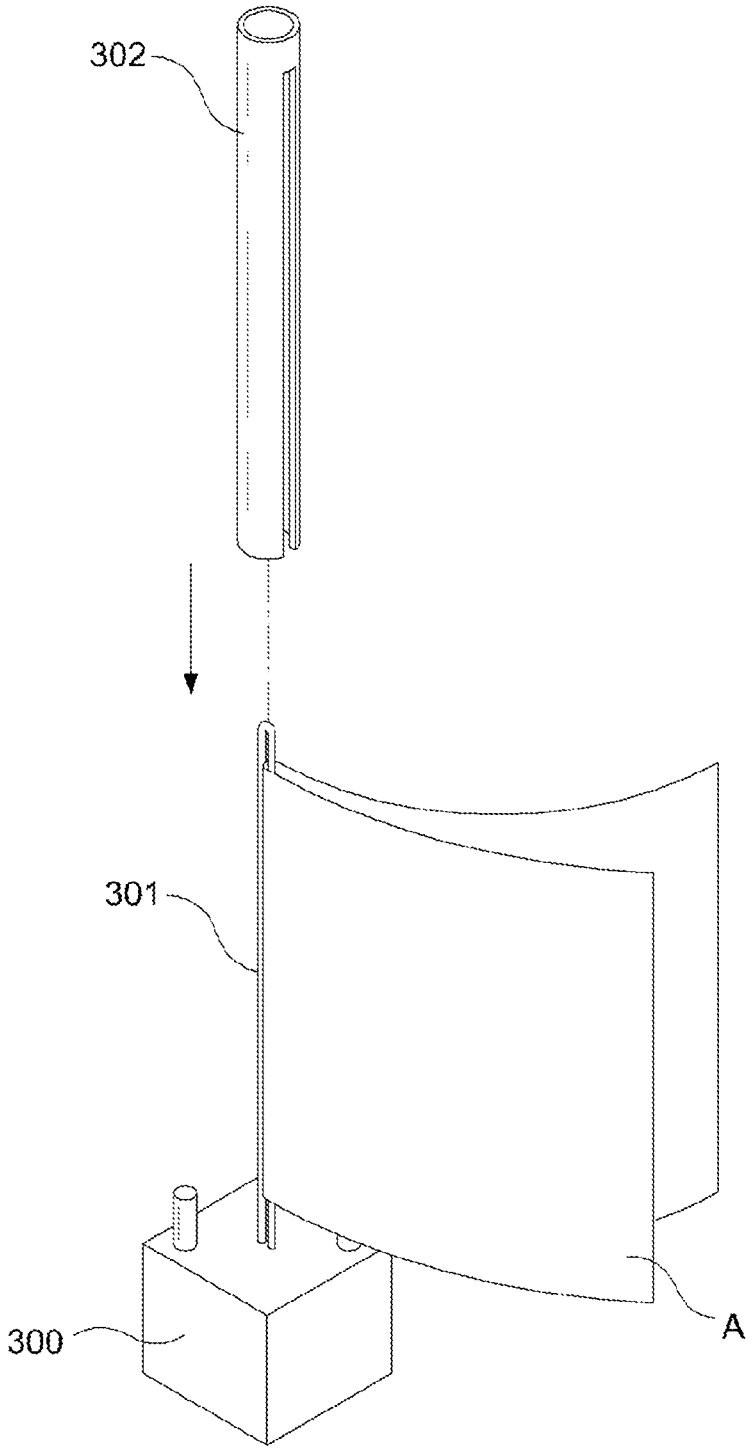
FIGS. 5 and 6 are perspective views illustrating fixing of a sacred object or a wish note to the contained object support using the cross for containing a sacred object or a wish note according to the preferred embodiment of the present disclosure.
Figure 6:
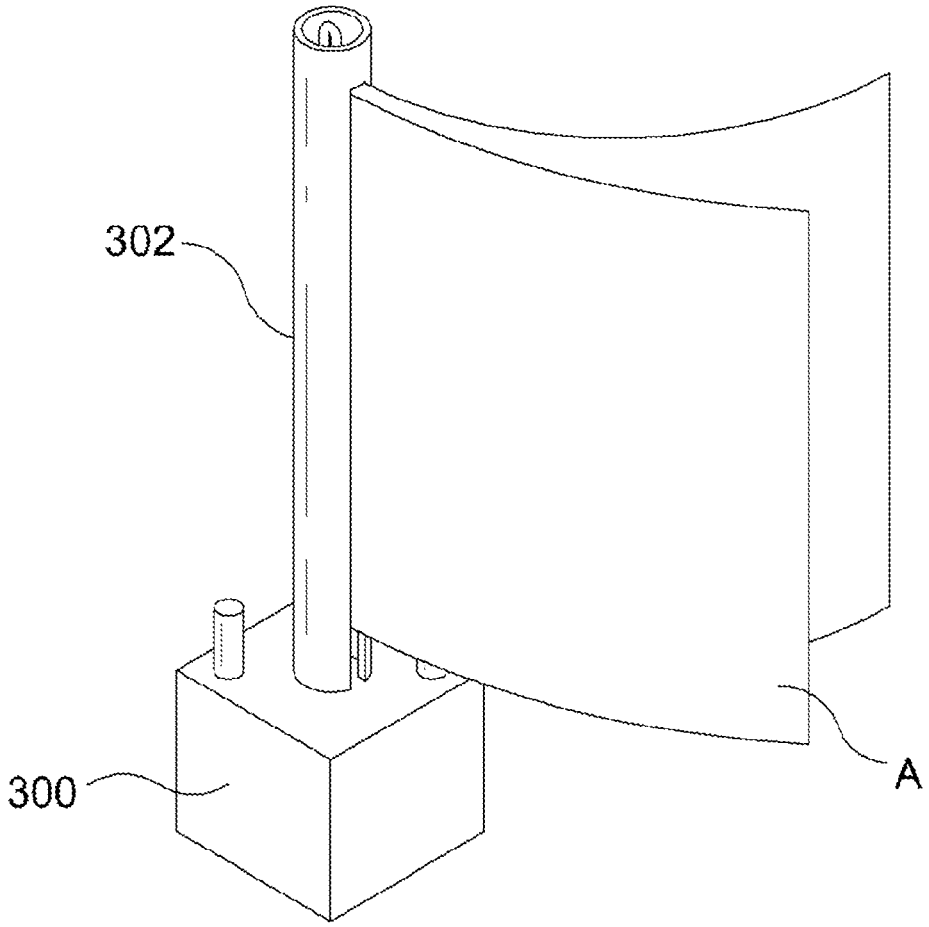
Figure 7:
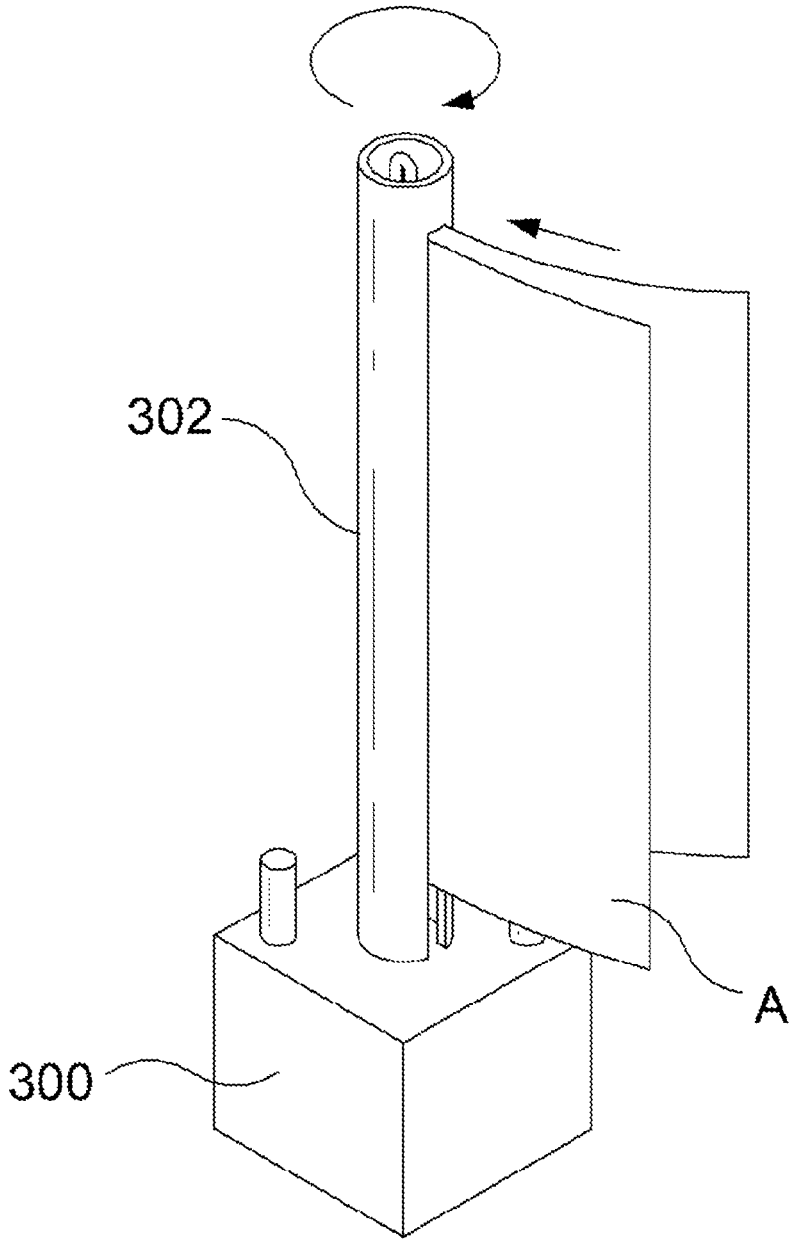
FIG. 7 is a perspective view illustrating fixing of a sacred object or a wish note to the contained object support by rotating the same using the contained object cover member and the opening of the cross for containing a sacred object or a wish note according to the preferred embodiment of the present disclosure.
Figure 8:
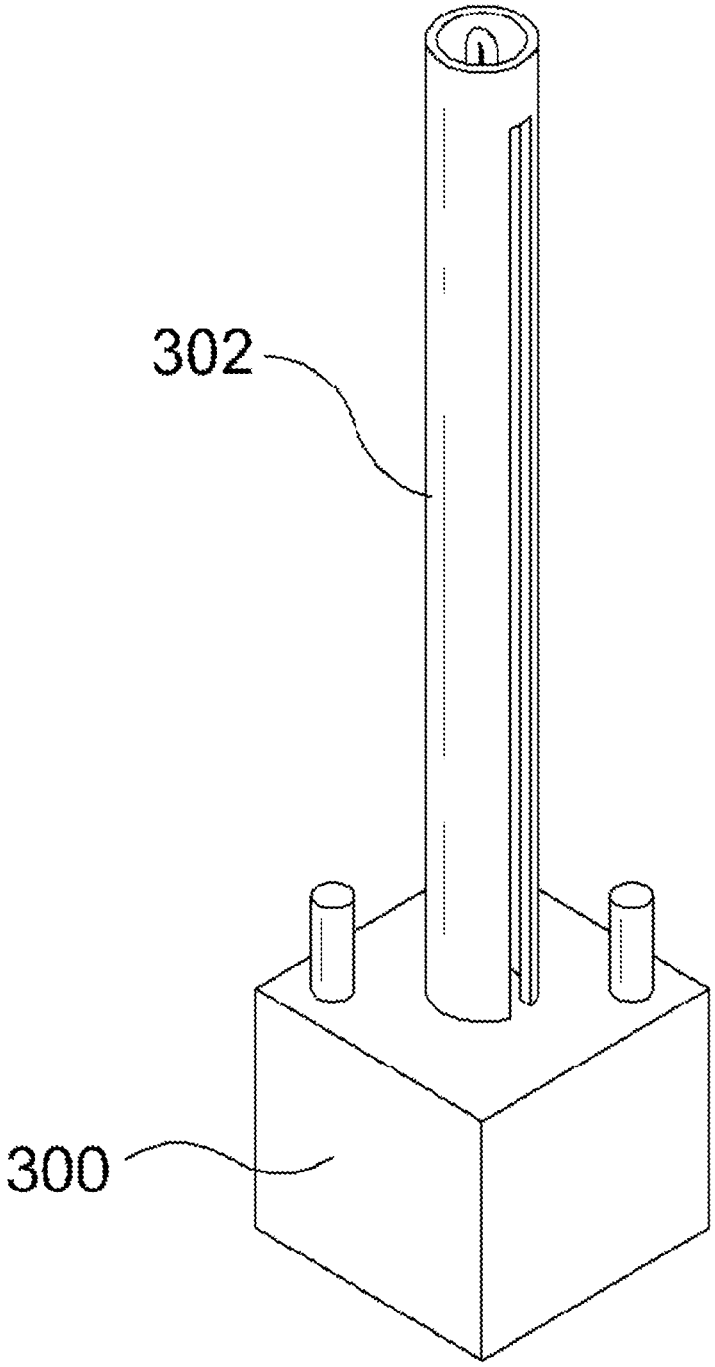
FIG. 8 is a perspective view illustrating insertion of a sacred object or a wish note into the cross for containing a sacred object or a wish note according to the preferred embodiment of the present disclosure.
Figure 9:
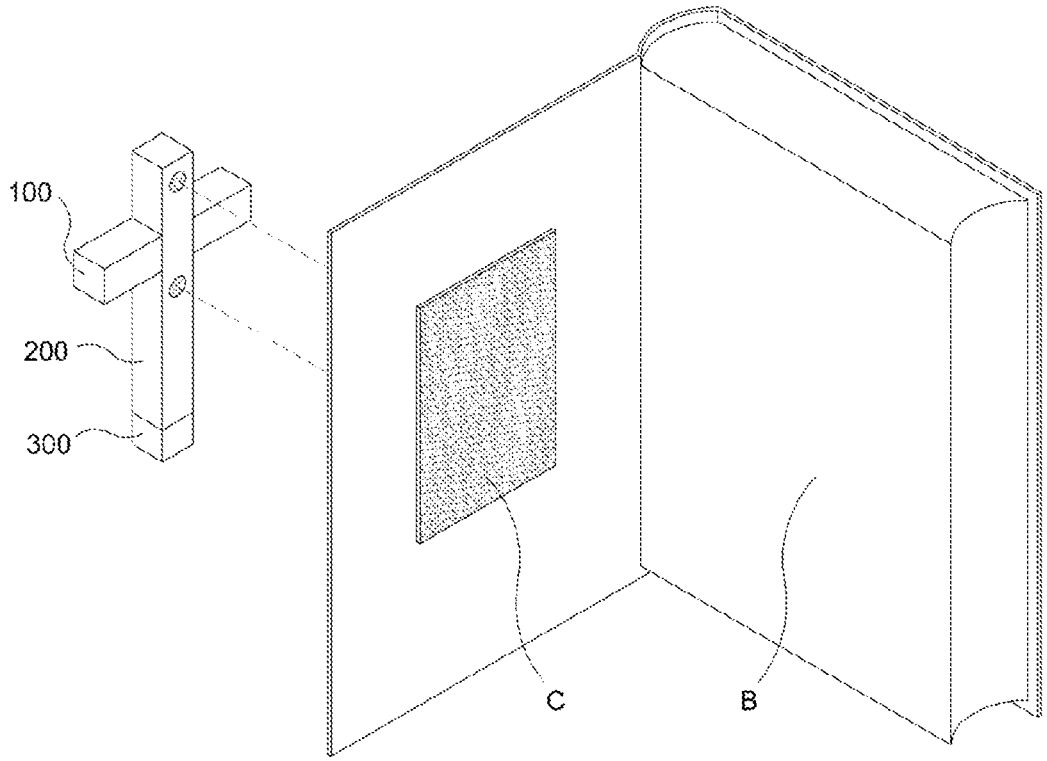
FIG. 9 is a perspective view illustrating a rear magnet of the cross for containing a sacred object or a wish note according to the preferred embodiment of the present disclosure.
Figure 10:
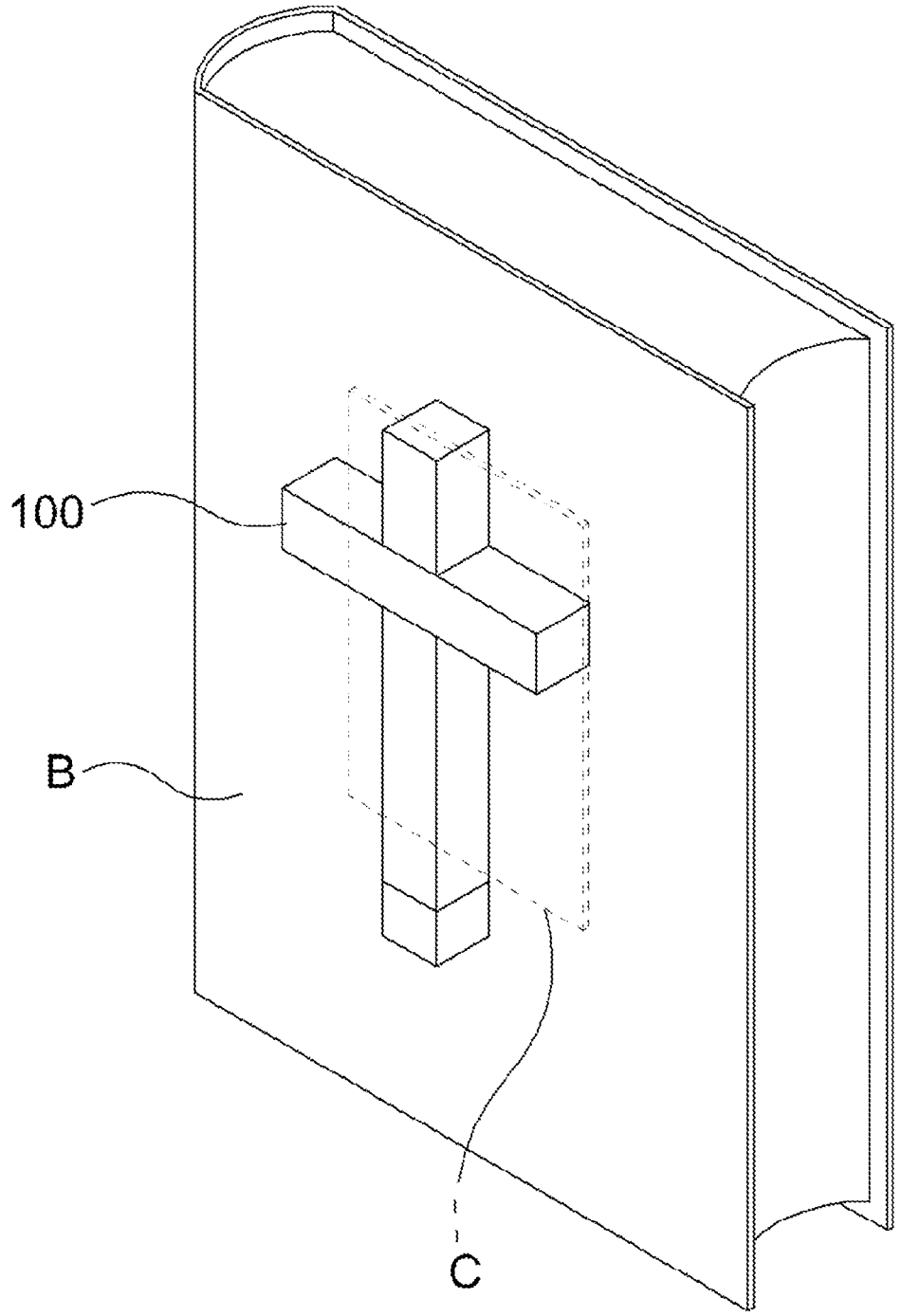
FIG. 10 is a perspective view illustrating attachment, to the bible, of the cross for containing a sacred object or a wish note according to the preferred embodiment of the present disclosure.

FIG. 1 is a perspective view of a cross for containing a sacred object or a wish note according to a preferred embodiment of the present disclosure, which is attached to the bible, and FIG. 2 is an exploded perspective view of the cross for containing a sacred object or a wish note according to the preferred embodiment of the present disclosure. FIG. 3 is a perspective view and conceptual diagram showing in detail a first containing portion and a first coupling member containing portion of the cross for containing a sacred object or a wish note according to the preferred embodiment of the present disclosure, and FIG. 4 is a perspective view illustrating, in detail, a contained object support, a contained object cover member, and a contained object insertion space of the cross for containing a sacred object or a wish note according to the preferred embodiment of the present disclosure. FIGS. 5 and 6 are perspective views illustrating fixing of a sacred object or a wish note to the contained object support using the cross for containing a sacred object or a wish note according to the preferred embodiment of the present disclosure, and FIG. 7 is a perspective view illustrating fixing of a sacred object or a wish note to the contained object support by rotating the same using the contained object cover member and the opening of the cross for containing a sacred object or a wish note according to the preferred embodiment of the present disclosure. FIG. 8 is a perspective view illustrating insertion of a sacred object or a wish note into the cross for containing a sacred object or a wish note according to the preferred embodiment of the present disclosure, and FIG. 9 is a perspective view illustrating a rear magnet of the cross for containing a sacred object or a wish note according to the preferred embodiment of the present disclosure. FIG. 10 is a perspective view illustrating attachment, to the Bible, of the cross for containing a sacred object or a wish note according to the preferred embodiment of the present disclosure.

As shown in FIGS. 1 and 2, the present invention, which provides a cross for containing a sacred object or a wish note, includes a transverse frame 100 arranged parallel to the ground to provide a cross capable of containing an object such as a sacred object or a wish note.

A first longitudinal frame 200 is arranged perpendicularly across the center of the transverse frame 100 arranged as described above to form a cross shape.

Here, a first containing portion 201 is formed in an inner center of the first longitudinal frame 200 to extend from a bottom surface of the first longitudinal frame 200 toward the transverse frame 100.

The first containing portion 201 may have a cylindrical shape or a polygonal shape.

Here, the bottom surface of the first longitudinal frame 200 is provided with a first coupling member containing portion 202 formed outside the first containing portion 201. Thus, a first frame magnet 203 arranged to be contained in the first coupling member containing portion 202.

As shown in FIG. 3, the first frame magnet 203 is formed to be shorter than the depth of the first coupling member containing portion 202, such that the first frame magnet 203 can be hidden inside the first coupling member containing portion 202.

A second longitudinal frame 300 is arranged to be coupled to the bottom surface of the first longitudinal frame 200 in surface contact therewith.

That is, when the bottom surface of the first longitudinal frame 200 is rectangular, the cross-section of the second longitudinal frame 300 may also be rectangular. Alternatively, the cross-section may have a circular shape or a polygonal shape.

A contained object support 301 is provided to a central portion of a top surface of the second longitudinal frame 300 and disposed at a position corresponding to the first containing portion 201 of the first longitudinal frame 200. A contained object cover member 302 is provided to be contained in the first containing portion 201 and to cover the contained object support 301.

Further, a second coupling member containing portion 303 is disposed outside the contained object support 301 at a position corresponding to the first coupling member containing portion 202, and a second frame magnet 304 is inserted into the second coupling member containing portion 303 to couple the first vertical frame 200 and the second vertical frame 300 by magnetic force with the first frame magnet 203.

Here, the first frame magnet 203 is formed to be shorter than the depth of the first coupling member containing portion 202, such that the first frame magnet 203 is hidden inside the first coupling member containing portion 202, and the second frame magnet 304 arranged to protrude is inserted into the remaining empty space.

The second frame magnet 304 is formed to be longer than the second coupling member containing portion 303, such that the second frame magnet 304 protrudes from the second coupling member containing portion 303 to the outside. The protruding portion may be accommodated in the first coupling member containing portion 202. Thus, the bottom surface of the first longitudinal frame 200 and the top surface of the second longitudinal frame 300 make a surface contact with each other.

In addition, as the second longitudinal frame 300 is formed on the top surface of the second longitudinal frame 300 to protrude therefrom, the second longitudinal frame 300 is prevented from being displaced even when it is laterally pressed.

Here, the contained object cover member 302 is formed in a cylindrical shape to be open on one side facing the second coupling member containing portion 303 and be closed on an opposite side to cover the contained object support 301.

Alternatively, the contained object cover member 302 may be formed to have the same length as the contained object support 301, and both sides of the contained object cover member 302 may be formed to be open.

The contained object cover member 302 may be formed in a cylindrical shape.

Thus, contained object cover member is open on one side facing the second coupling member containing portion 303 and be closed on an opposite side to cover the contained object support 301. Thereby, the cross for containing a Bible prayer or wish note is configured.

Here, the contained object cover member 302 may be provided with an opening 302*a* formed in a portion of the side surface thereof from one side facing the second coupling member containing portion 303 to the opposite side.

As shown in FIGS. 4 to 7, after a sacred utensil or a wish note is inserted into the contained object support 301 and fixing, it is covered with the contained object cover member 302. Then, the contained object cover member 302 is rotated, the sacred utensil or wish note is rolled around the contained object support 301.

The contained object support 301 may further include a contained object insertion space 301*a* having a length extending from a top surface of the second longitudinal frame 300 to a top surface of the first containing portion 201, the contained object insertion space allowing the contained object to be fitted thereinto. Thereby, the sacred utensil or wish node may be further easily inserted and fixed.

The contained object insertion space 301*a* may be formed by bending a wire in a U-shape or a square-bracket plate as exemplarily shown in FIG. 4 to have a gap allowing a sacred utensil or a wish note to be fitted thereinto.

The first longitudinal frame 200 or the transverse frame 100 may further include a rear space 101 formed in a rear surface thereof to allow a rear magnet 101*a* to be inserted into the rear space 101.

That is, as shown in FIGS. 9 and 10, a magnet C may be provided on the inner surface of the cover sheet of the Bible so as to be coupled to the rear magnet 101*a* by magnetic force such that the cross according to the present disclosure can be fixed to the Bible or carried.

By providing believers with the cross for containing a sacred utensil or a wish note configured as above, faith may be raised among the believers. In addition, as the containing space to contain the sacred utensils or wish notes is provided, the believers may conveniently store and keep the contents with sacred notes along with the cross. In addition, as the longitudinal frame is detachably coupled to the cross, believers may be allowed to conveniently use the cross. Further, as a contained object support allowing a sacred utensil or a wish note to be into a hollow portion formed therein is provided, the inserted object may be securely fixed. Also, as the magnetic member is provided on the back of the cross such that the cross is firmly attached to the Bible or the like, the contained object may be easily stored and carried while deepening the faith.

The present disclosure has been described above through a preferred embodiment, but the above-described embodiment is only illustrative of the technical idea of the present disclosure. It will be understood by those skilled in the art that various changes are possible within the spirit of the present disclosure. Therefore, the scope of protection of the present invention should be interpreted not by a specific embodiment, but by the claims, and all technical ideas within the scope equivalent thereto should be interpreted as being included in the scope of the present invention.

REFERENCE NUMERALS

100 Transverse frame
101 Rear space
101*a* Rear magnet
200 First longitudinal frame
201 First containing portion
202 First coupling member containing portion
203 First frame magnet
300 Second longitudinal frame
301 Contained object support
301*a* Contained object insertion space
302 Contained object cover member
302*a* Opening
303 Second coupling member containing portion
304 Second frame magnet
A Contained object
B Bible
C Magnet

The invention claimed is:

1. A cross for containing a sacred utensil or a wish note, comprising:

a transverse frame arranged parallel to a ground to constitute a cross to contain objects;

a first longitudinal frame perpendicularly arranged across a center of the transverse frame;

a first containing portion formed in an inner center of the first longitudinal frame to extend from a bottom surface of the first longitudinal frame toward the transverse frame;

a first coupling member containing portion formed outside the first containing portion in the bottom surface of the first longitudinal frame;

a first frame magnet arranged to be contained in the first coupling member containing portion;

a second longitudinal frame coupled to the bottom surface of the first longitudinal frame in surface contact therewith;

a contained object support provided to a central portion of a top surface of the second longitudinal frame and disposed at a position corresponding to the first containing portion of the first longitudinal frame;

a contained object cover member arranged to be contained in the first containing portion and to cover the contained object support;

a second coupling member containing portion formed outside the contained object support at a position corresponding to the first coupling member containing portion; and a second frame magnet inserted into the second coupling member containing portion to couple the first longitudinal frame and the second longitudinal frame by magnetic force with the first frame magnet, wherein the first frame magnet is formed to be shorter than the first coupling member containing portion, such that the first frame magnet is hidden inside the first coupling member containing portion, wherein the second frame magnet is formed to be longer than the second coupling member containing portion, such that the second frame magnet protrudes from the second coupling member containing portion to an outside, and wherein a protruding portion of the second frame magnet is accommodated in the first coupling member containing portion.

2. The cross of claim 1, wherein the contained object cover member is formed in a cylindrical shape to be open on one side facing the second coupling member containing portion and be closed on an opposite side to cover the contained object support.

3. The cross of claim 2, wherein the contained object cover member is provided with an opening formed in a portion of the side surface thereof from one side facing the second coupling member containing portion to the opposite side.

4. The cross of claim 1, wherein the contained object support further comprises a contained object insertion space having a length extending from a top surface of the second longitudinal frame to a top surface of the first containing portion, the contained object insertion space allowing the contained object to be fitted thereinto.

5. The cross of claim 1, wherein the first longitudinal frame or the transverse frame may further include a rear space formed in a rear surface thereof to allow a rear magnet to be inserted into the rear space.

* * * * *